United States Patent [19]

Effler et al.

[11] Patent Number: 4,667,425

[45] Date of Patent: May 26, 1987

[54] BASEBALL SHOE WITH IMPROVED OUTSOLE

[75] Inventors: Kenneth T. Effler, Memphis, Tenn.; Douglas H. Miner, Exeter, N.H.

[73] Assignee: Nike, Inc., Beaverton, Oreg.

[21] Appl. No.: 523,578

[22] Filed: Aug. 16, 1983

[51] Int. Cl.[4] ..... A43B 5/00

[52] U.S. Cl. ..... 36/126; 36/114; 36/59 R

[58] Field of Search ..... 36/114, 115, 116, 126, 36/127, 128, 129, 134, 32 R, 59 C, 67 A

[56] References Cited

U.S. PATENT DOCUMENTS

| | | | |
|---|---|---|---|
| D. 272,772 | 2/1984 | Kohno | D2/04 |
| 3,127,687 | 4/1964 | Hollister et al. . | |
| 3,352,034 | 11/1967 | Braun | 36/67 |
| 3,466,763 | 9/1969 | Levin . | |
| 3,577,663 | 5/1971 | Mershon | 36/67 |
| 3,680,231 | 8/1972 | Dymond | 36/59 R |
| 3,977,096 | 8/1976 | Murray | 36/59 R |
| 4,067,123 | 1/1978 | Minihane | 36/128 X |
| 4,085,527 | 4/1978 | Riggs | 36/114 |
| 4,135,317 | 1/1979 | Ikeda | 36/134 |
| 4,167,071 | 9/1979 | Koransky | 36/127 |
| 4,173,083 | 11/1979 | Infusino | 36/128 X |
| 4,327,503 | 5/1982 | Johnson | 36/32 R |
| 4,347,674 | 9/1982 | George | 36/126 |
| 4,527,344 | 7/1985 | Mozena | 36/126 |

FOREIGN PATENT DOCUMENTS

| | | | |
|---|---|---|---|
| 249549 | 9/1966 | Austria | 36/59 C |
| 2618588 | 10/1977 | Fed. Rep. of Germany | 36/59 R |
| 1362632 | 4/1964 | France | 36/114 |
| 1554061 | 12/1968 | France | 36/114 |

OTHER PUBLICATIONS

Advertisement, "Brooklyn" Shoe, Curley-Bates, 1983 catalog, Mizuno Shoes.

*Primary Examiner*—Werner H. Schroeder
*Assistant Examiner*—T. Graveline
*Attorney, Agent, or Firm*—Banner, Birch, McKie & Beckett

[57] ABSTRACT

A baseball shoe is disclosed, which is comprised of an upper and a cleated sole attached to the upper. The cleated sole is formed of a single integral piece of plastic which includes a base extending through the toe, ball, arch and heel sections of the shoe. A pluality of first and second cleats extend from the base. The first cleats are arranged in a front group about the periphery of the toe and ball sections, and in a back group in a generally circular arrangement in the heel section. The first cleats have a generally flat rectangular-shaped ground engaging surface, an outer surface, a concave inner surface, a pair of side surfaces and a rib extending from the concave inner surface. The second cleats are located generally in the forefoot area of the shoe and have a generally cylindrical configuration will a round ground engaging surface.

22 Claims, 5 Drawing Figures

BASEBALL SHOE WITH IMPROVED OUTSOLE

TECHNICAL FIELD

The present invention relates to cleated athletic shoes, and, more particularly, to a baseball shoe having an integral plastic outsole.

BACKGROUND OF THE INVENTION

The modern athletic shoe is a highly refined combination of many elements which have specific functions, all of which work together for the support and protection of the foot during an athletic event. The various elements of the athletic shoe also should be designed to enhance or aid the performance of an athlete in an athletic event. A shoe is divided into two general parts, an upper and a sole.

The upper is designed to snugly and comfortably enclose the foot. Typically, it will have several layers including a weather and wear-resistant outer layer of leather or synthetic material, such as nylon, and a soft, padded inner layer for foot comfort. The other major portion of an athletic shoe is the sole. In a training shoe designed for running, the sole must have an extremely durable bottom surface to contact the ground, together with a shock absorbing midsole to absorb the considerable force to which the foot and leg are subjected during the repeated ground contact which occurs during long distance running or jogging.

Where an athletic event requires rapid acceleration and deceleration, and where ground conditions permit, cleats are frequently incorporated into the outsole of athletic shoes to enhance traction. The particular shape of the cleats and their location along the outsole depend upon the particular event for which the soles are designed, and in some instances, upon the ground surfaces on which the shoes will be used. Athletic shoes with cleated outsoles are used in track and field events such as sprint races, jumping, and javelin throwing, and in sports such as soccer, football and baseball.

Examples of specialized athletic shoes with cleated outsoles are found in the patent literature. A cleated athletic shoe designed for use in a variety of athletic events such as baseball and football is disclosed in U.s. Pat. No. 4,327,503 issued on May 4, 1982 to Jeffrey O. Johnson. The sole in the '503 patent includes relatively large first cleats disposed about the periphery of the outsole and a plurality of smaller second cleats located in interior areas of the outsole. The peripheral first cleats are in the shape of a section of a frustrum, while the interior second cleats are generally conical shaped. Athletic shoes particularly adapted for use in baseball are disclosed in U.S. Pat. Nos. 4,347,674 and 3,977,096. In the '674 patent, curved thin plate cleats are formed in a circular arrangement at both the forefoot and heel portions of the sole. The cleats can be made of any rigid material, such as steel, or a rigid rubber. In the '096 patent, cleats or spikes extend from a spike plate which is resiliently mounted to the heel.

A typical baseball shoe with metal sleats uses a goup of three metal cleats in the forefoot portion of the sole and a second group of three metal cleats in the heel portion of the sole. Each of the metal cleats is in the form of a thin metal plate, e.g., 1/16" thick, which is relatively long, e.g., 5/8", and high, e.g., 7/16". Such metal cleats provide good traction in a variety of surfaces. The metal cleats dig in well into the dirt of a batter's box, and penetrate through grass, wet or dry, into the dirt subsurface of the outfield. However, beginning with the spring 1984 season, metal cleats on baseball shoes will no longer be permitted for use in high school baseball. Thus, a cleat arrangement and shape which will accomplishes the objectives of metal cleats, but is constructed of plastic is required for high school baseball shoes. The present invention was designed to accomplish this purpose. Of course, the baseball shoe of the present invention can be used in other levels of baseball competition.

SUMMARY OF THE INVENTION

The present invention is directed to a baseball shoe comprising an upper and a cleated sole attached to the upper. The cleated sole is formed of a single integral piece of plastic and includes a base extending through the toe, ball, arch and heel sections of the shoe and a plurality of cleats extending from the base. The cleats are arranged in a front gap about the periphery of the toe and ball sections, and in a back group in a generally circular arrangement in the heel section. The cleats have a generally flat rectangular-shaped ground engaging surface, an outer surface, a concave inner surface, a pair of side surfaces extending between the inner and outer surfaces, and a rib extending from the concave inner surface. The outer surface of the cleats in the front group face and align with the peripheral border of the sole. The outer surface of the cleats in the back group face outward of the circular arrangement, and the concave inner surfaces face opposite to the outer surfaces.

In a preferred embodiment, second cleats are located generally in the forefoot area of the shoe and have a generally cylindrical configuration with a round ground engaging surface. The outer surface preferably has a slight concave curvature, while the inner surface has a much greater concave curvature, which allows the ground engaging surface of the cleats to be relatively small for ground penetration purposes while the base is relatively broad for strength. The ribs extend from adjacent to the ground engaging surface to the base and have a substantially flat ground facing surface. The ribs provide additional strength to the cleats. The ground engaging surface and outer surface of each of the cleats in the back group extends at substantially a 45° angle with respect to a line bisecting the heel and arch areas of the shoe.

A shoe constructed in accordance with the present invention has the advantage of retaining the desirable functional aspects of a metal cleated baseball shoe in a plastic sole, while also enhancing comfort. The concave inner and outer surfaces of the first cleats allow the ground engaging surface to the cleats to take on an elongate configuration which enhances ground penetration while also resulting in a broad base that enhances the strength of the cleat. Also by forming the outer surface with a very small curvature, the cleats can be placed close to the perimeter of the sole to enhance stability. A relatively large number of first cleats, i.e., twelve are used, as compared to six metal cleats, so that comfort is improved and wear of the cleats is lessened becauses stresses are distributed over the larger number of cleats.

Various advantages and features of novelty which characterize the invention are pointed out with particularity in the claims annexed hereto and forming a part hereof. However, for a better understanding of the invention, its advantages, and objects obtained by its use, reference should be made to the drawings which form a part hereof and to the accompanying descriptive manner in which there is illustrated and described a preferred embodiment of the invention.

DETAILED DESCRIPTION OF THE INVENTION

Figure 1:
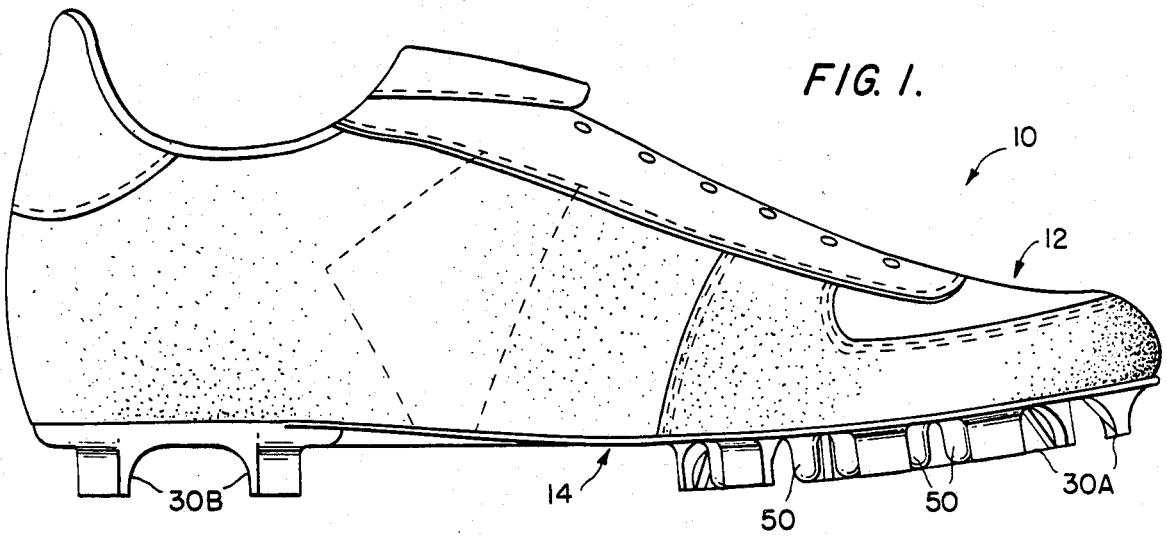
FIG. 1 is a side elevational of an athletic shoe in accordance with the present invention.

Referring to the drawings in detail, wherein like numbers indicate like elements, there is shown in FIG. 1 an athletic shoe designated generally as 10. Shoe 10 includes a shoe upper 12 and an outsole 14. Upper 12 can be made of any conventional design. Outsole 14 is formed of a single integral piece of plastic and is attached to upper 12 by rivets 16. Additional or other conventional attachment means such as gluing can also be used. Outsole 14 is made of a relatively hard, dense, but flexible plastic such as dense polyurethane.

Outsole 14 includes a base 18 which extends through the entire length of the sole, i.e., through heel section 20 rearward of line $L_1$, through arch section 22 between lines $L_1$ and $L_2$, through ball section 24 between lines $L_2$ and $L_3$ and through toe section 26 forward of line $L_3$. The area forward of of line $L_2$ is also generally referred to as the forefoot area. Areas 20, 22, 24 and 26 correspond approximately to the respective areas of the foot inserted into the shoe, however, lines $L_1$–$L_3$ are not intended to delineate precise lines of demarcation, but rather are approximations for purposes of discussing various structural and functional aspects of the invention.

Base 18 has a generally uniform thickness $t_1$ in the ball and toe areas 24, 26. In heel section 20, base 18 has a substantially greater thickness $t_2$. In arch area 22, base 18 has a maximum thickness $t_3$ along the longitudinal center of the arch section, and tapers from the maximum thickness $t_3$ to a minimum thickness along the medial and lateral edges of base 18. The central maximum thickness $t_3$ slopes from a maximum adjacent heel area 20, where it is approximately the same as thickness $t_2$, to a minimum at the front of arch section 22, wherein it tapers to a thickness equal to the thickness $t_1$ in ball and toe sections 24, 26. The additional thickness of base 18 in heel section 20 provides additional strength to the sole in the heel section, which undergoes relatively high stresses.

A plurality of first cleats 30 are formed integral with and extend downwardly from base 18. First cleats 30 are arranged in a first group **30*a* in ball and toe sections 24, 26, and in a second group 30*b* in heel section 20. The first group of cleats 30*a* are arranged about the perimeter of ball and toe sections 24, 26, and the second group of cleats 30*b* are disposed in a circular arrangement in heel section 20**.

Each cleat 30 has an outer surface 32, an inner surface 34, a ground engaging surface 36, a pair of spaced side surfaces 38, 40, and a rib 42. Outer surfaces 32 of the first group of cleats **30*a* face and are aligned with the perimeter of border of sole 14 which is immediately adjacent to each respective cleat 30*a*. Outer surfaces 32 of the second group of cleats 30*b* face outward of the circular arrangement in which cleats 30*b* are disposed and therefore outward of the center of heel section 20. Outer surfaces 32 and ground engaging surfaces 36 of the second group of cleats 30*b* and, hence cleats 30*b*, extend at an angle A of approximately 45° with respect to a rear foot longitudinal line $L_4$ extending longitudinally along the center of the sole in the heel and arch sections 20, 22. The disposition of the four cleats 30*b* results in particularly stable heel support. The two rearwardmost cleats 30*b* provide improved stability over the typical single metal cleat at the back of a baseball shoe. Inside surfaces 34 of cleats 30 are diametrically opposite to outside surfaces 32**.

Figure 2:
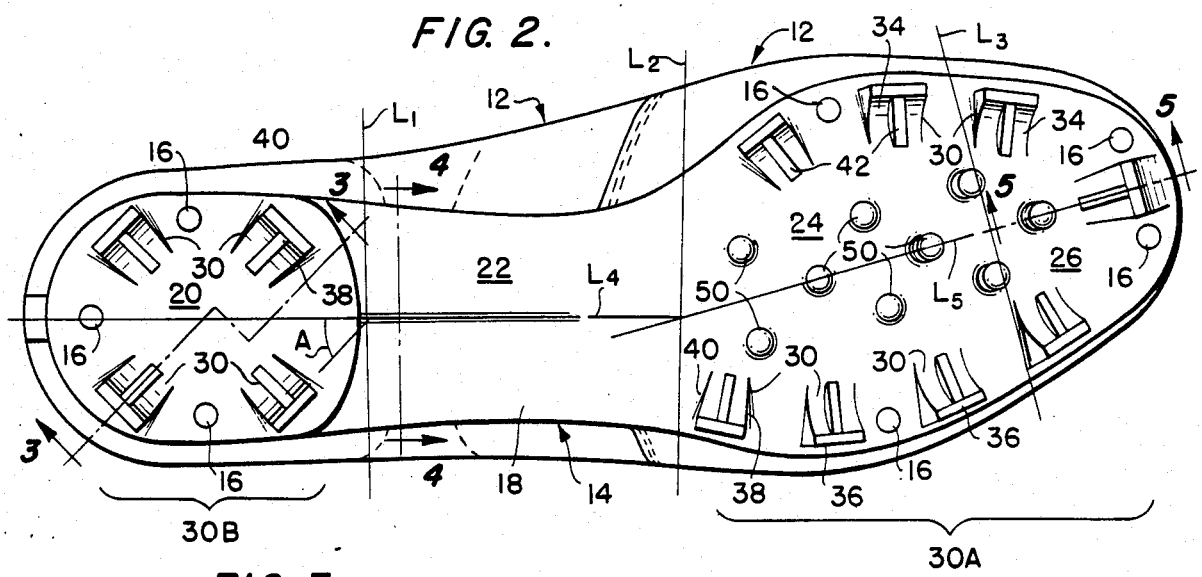
FIG. 2 is a bottom plan of the shoe.
Figure 3:
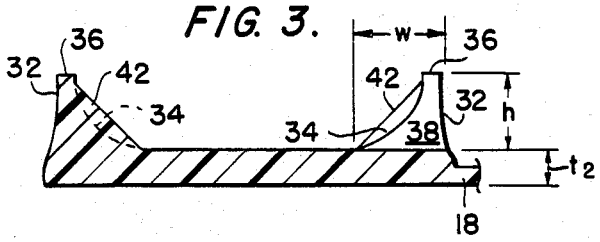
FIG. 3 is a cross-sectional view taken generally along lines 3—3 of FIG. 2.

A majority of cleats 30, all but the forwardmost of cleats **30*a*, have outer surfaces 32 with a small concave curvature, i.e., a curvature with a large radius. All of the cleats 30 have inside surfaces 34 with a concave curvature greater than that of the majority of the outside surfaces 32, i.e., a curvature with a smaller radius than that of the outer surface. By forming outer and inner surfaces 32, 34 with concave curvatures, ground engaging surface 36 can be made relatively small to enhance ground penetration of cleats, while the base of cleats 30 can be made relatively broad to enhance their strength. Thus, the cleats 30 have a width W which is at least as great as the height H of the cleats so that a strong connection with base 18 is formed. Each rib 42 extends from a point adjacent to ground engaging surface 36 to base 18, and has a ground facing surface which is substantially flat. As seen in FIG. 2, rib 42 extends along the center of the length of concave inner surface 34, and also adds strength to cleats 30. Additionally, by forming the inner surface in a concave shape, rather than straight, the strengthening of cleats 30** is attained without the use of unnecessary material.

Ground engaging surface 36 is preferably rectangular-shaped, as are the ground engaging surfaces of the metal cleats, in order to provide the type of ground penetration customary in baseball shoes. By using the large concave surfaces 34, ground engaging surface 36 can be relatively thin or sharp, further enhancing its ground penetrating capability. Ground engaging surface 36 is preferably flat, and is defined between inner and outer surfaces 32, 34 and side surfaces 38 and 40, which are also preferably flat. If sufficient strength is provided by curving inner surfaces 34 to a broad base, outer surfaces 32 could also be formed flat.

Figure 5:
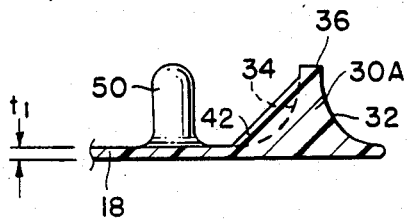
FIG. 5 is a cross-sectional view taken generally along line 5—5 of FIG. 2.
Figure 4:
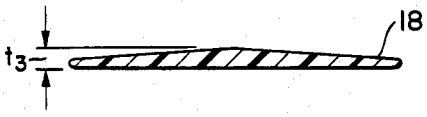
FIG. 4 is a cross-sectional view taken generally along line 4—4 of FIG. 2.

The forwardmost of cleats **30*a*, shown in detail in FIG. 5, has an outer surface with a curvature approximating that of its inner surface, and thus a greater curvature than that of the outer surfaces of the remaining cleats 30. The strength of forwardmost cleat 30*a* is thus further enhanced by its broader base. Forwardmost cleat 30*a* is located slightly back of the tip of sole 14 to make the roll-off easier. As seen in FIG. 2, forwardmost cleat 30*a* is preferably aligned perpendicular to a forefoot longitudinal line $L_5$ which bisects ball and toe sections 24, 26**.

A plurality of second cleats 50 are located primarily in the ball section 24, but also in toe section 26, i.e., in the forefoot area. Cleats 50 have a generally cylindrical configuration with a rounded ground engaging surface. The cross-section of cylindrical shaped cleats 50, adjacent base 18, is less than the cross-sectional area of cleats 30 adjacent base 18. Cleats 50 thus are smaller than cleats 30. Also, as seen in FIG. 5, cleats 50 have approximately the same height as cleats 30. Cleats 50 provide support and traction under the ball of the foot, and are made smaller than cleats 30 in order not to detract from the traction-penetration function of cleats 30.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principal of the invention, to the full extent indicated by the broad general meaning of the terms in which the appended claims are expressed.

We claim:

1. A baseball shoe comprising:

an upper; and a cleated sole attached to said upper;

said cleated sole being formed of a single integral piece of plastic including a base extending through the toe, ball, arch and heel sections of the shoe and a plurality of first and second cleats extending from said base;

said first cleats being arranged in a front group about the periphery of said toe and ball sections and in a back group in generally circular arrangement in said heel section, said first cleats having a generally rectangular-shaped ground engaging surface, an outer surface, concave inner surface and a pair of side surfaces extending between said inner and outer surfaces, the outer surface of said first cleats in said front group facing and aligning with the peripheral border of said sole, the outer surface of said first cleats in said back group facing outward of the circular arrangement, and said concave inner surfaces facing opposite to said outer surfaces;

said second cleats being smaller than said first cleats and being located generally in the forefoot area of the shoe.

2. A baseball shoe in accordance with claim 1 wherein substantially all of said outer surfaces have a small concave curvature.

3. A baseball shoe in accordance with claim 2 wherein the forwardmost first cleat in said front group has a concave curvature approximately the same as the concave curvature of its inner surface.

4. A baseball shoe in accordance with claim 1 wherein said first cleats include ribs extending from adjacent to said ground engaging surface to said base.

5. A baseball shoe in accordance with claim 4 wherein said ribs have a substantially flat ground facing surface.

6. A baseball shoe in accordance with claim 4 wherein said ribs are located along the lengthwise center of said inner surfaces.

7. A baseball shoe in accordance with claim 1 wherein said ground engaging surface and said inner and outer surfaces of said forwardmost first cleat in said front group are generally perpendicular to a longitudinal line bisecting the toe and ball areas of the shoe.

8. A baseball shoe in accordance with claim 1 wherein the ground engaging surface and said inner and outer surfaces of each first cleat in said back group extend at substantially a 45° angle with respect to a longitudinal line bisecting the heel and arch areas of the shoe.

9. A baseball shoe in accordance with claim 1 wherein said sole is formed of polyurethane.

10. A baseball shoe comprising:

an upper; and a cleated sole attached to said upper;

said cleated sole being formed of a single integral piece of plastic including a base extending through the toe, ball, arch and heel sections of the shoe and a plurality of first and second cleats extending from said base;

said first cleats being arranged in a front group about the periphery of said toe and ball sections and in a back group in generally circular arrangement in said heel section, said first cleats having a generally flat rectangular-shaped ground engaging surface, an outer surface, concave inner surface, a pair of side surfaces extending between said inner and outer surfaces, and a rib extending from a said concave inner surface, the outer surface of said first cleats in said front group facing and aligning with the peripheral border of said sole and the outer surface of the forwardmost first cleat being concave, the outer surface of said first cleats in said back group facing outward of the circular arrangement, and said concave inner surfaces facing opposite to said outer surfaces;

said second cleats being located generally in the forefoot area of the shoe and having a generally cylindrical configuration with a round ground engaging surface.

11. A sole for use with a baseball shoe comprising a body formed of an integral piece of plastic having a base extending along the toe, ball, arch and heel sections of the sole and a plurality of cleats extending from said base, said cleats including a first group of cleats arranged about the perimeter of the toe and ball sections and a second group of cleats arranged in a generally circular pattern in the heel section, said cleats in said first and second groups having a generally flat rectangular-shaped ground engaging surface, an outer surface, a concave inner surface, and a pair of side surfaces extending between said inner and outer surfaces, the outer surfaces of said cleats in said first group facing and aligning with the perimeter adjacent each respective cleat, the outer surfaces of said cleats in said second group facing outward of the circular arrangement, said concave inner surfaces facing opposite to said outer surfaces, and the ground engaging surfaces of said cleats in said second group being disposed at approximately at 45° angle with respect to a rearfoot longitudinal line bisecting the heel and arch sections of said sole.

12. A sole in accordance with claim 11 wherein the width of said cleats between said inner and outer surfaces adjacent to said base is at least as large as said height of said cleats from said base to said ground engaging surface.

13. A sole in accordance with claim 11 including a rib extending from said inner surface of said cleats and between a point adjacent to said ground engaging surface and said base.

14. A sole in accordance with claim 13 wherein said ribs have a substantially flat ground facing surface.

15. A sole in accordance with claim 11 wherein a forwardmost cleat of said first group is disposed substantially perpendicular to a forefoot longitudinal line bisecting the ball and toe sections of said sole.

16. A sole in accordance with claim 11 including a third group of cleats formed integrally with said base and located in the forefoot area of the sole between the first group of cleats, said cleats in the third group being smaller than the cleats in said first group.

17. A sole in accordance with claim 16 wherein said cleats in the third group have a generally cylindrical configuration.

18. A sole in accordance with claim 11 wherein said cleats in the second group extend from a portion of said base thicker than the remaining portion of said base.

19. A sole in accordance with claim 11 wherein the base in said arch section tapers from a thickest portion along the longitudinal center to a thinnest portion along the medial and lateral sides.

20. A sole in accordance with claim 11 wherein the majority of said outer surfaces have a concave configuration smaller than the concave configuration of said inner surfaces.

21. A sole for use with a baseball shoe comprising:

a body formed of an integral piece of plastic, said body including a base and a plurality of first and second cleats extending from the base;

said base extending along the toe, ball, arch and heel sections of the sole, said base having a varying thickness with the thickest portion thereof located in said heel;

said first cleats being arranged in a front group about the periphery of said toe and ball sections and in a back group in a generally circular arrangement in said heel section, said first cleats having a generally flat rectangular-shaped ground engaging surface, an outer surface, a concave inner surface, a pair of side surfaces extending between said inner and outer surfaces, and a rib extending from said inner surface and between adjacent to said ground engaging surface and said base;

a forwardmost first cleat of said front group having a concave surface;

said outer surfaces of said front group of said first cleats facing and aligning with the border of said sole;

said outer surfaces of said back group of said first cleats facing outward of said circular arrangement and extending at an angle of approximately 45° with respect to a longitudinal line bisecting the heel and arch sections of said sole;

said inner surfaces facing opposite to the associated outer surfaces;

the width of said first cleats adjacent to said base and between said inner and outer surfaces being at least as great as the height of said first cleats between said base and said ground engaging surface;

said second cleats being located generally in the forefoot area of the shoe and having a generally cylindrical configuration with a cross-sectional area adjacent the base smaller than the cross-sectional area of the first cleats adjacent the base.

22. A sole in accordance with claim 21 wherein said body is formed of polyurethane.

* * * * *